US005499077A

United States Patent [19]

Endo et al.

[11] Patent Number: 5,499,077

[45] Date of Patent: Mar. 12, 1996

[54] TONER LEVEL DETECTING DEVICE

[75] Inventors: Yoshinori Endo, Toyota; Kazuhito Ishida, Nagoya, both of Japan

[73] Assignee: Brother Kogyo Kabushiki Kaisha, Nagoya, Japan

[21] Appl. No.: 434,337

[22] Filed: May 2, 1995

[30] Foreign Application Priority Data

May 17, 1994 [JP] Japan ..... 6-102769
Jul. 18, 1994 [JP] Japan ..... 6-165265

[51] Int. Cl.[6] ..... G03G 15/08

[52] U.S. Cl. ..... 355/203; 250/577; 340/617

[58] Field of Search ..... 355/203, 245, 355/246, 260, 206; 118/691, 694; 356/436; 340/617; 250/577

[56] References Cited

U.S. PATENT DOCUMENTS 4,197,813 4/1980 Yano et al. ..... 118/694
4,292,530 9/1981 Nepper et al. ..... 250/577
4,646,679 3/1987 Ohno et al. ..... 118/691

FOREIGN PATENT DOCUMENTS 55-163562 12/1980 Japan .
60-2660 1/1985 Japan .
63-2087 1/1988 Japan ..... 355/203

*Primary Examiner*—Joan H. Pendegrass
*Attorney, Agent, or Firm*—Oliff & Berridge

[57] ABSTRACT

A toner level detecting device on a toner supply box includes first and second light transmissive toner detecting portions connected by a connecting portion. An aperture between the first and second toner detecting portions is filled with toner when the toner level in the toner supply box is high. Light may be projected onto the first toner detecting portion so that it is aimed through the aperture and the second toner detecting portion. When the toner level in the toner supply box becomes low, toner will no longer fill the aperture, thus allowing light to pass through the aperture and the second toner detecting portion where it can be sensed by a light detector. Light may be attenuated as it passes through the connecting portion by an irregular surface portion on the connecting portion, by a light absorbative coating applied to a surface of the connecting portion, or by forming the connecting portion of a light absorbative material. A cleaning member may also be provided in the toner supply box to clean toner out from between the first and second toner detecting portions.

21 Claims, 7 Drawing Sheets

TONER LEVEL DETECTING DEVICE

BACKGROUND OF THE INVENTION

1. Field of the Invention

The present invention relates to a toner level detecting device in a unit for supplying toner to a developing unit of an image forming apparatus such as a printer, copying machine, or facsimile machine.

2. Description of the Related Art

In a known image forming apparatus, a dry development method may be used wherein development is performed by supplying toner to a development region on the surface of a photosensitive drum. As disclosed in Japanese Patent Publication No. 60-2660, such an image forming apparatus may include a casing of a developing unit; a developing sleeve rotatably mounted in the casing, the developing sleeve carrying on its outer circumference a mixture of toner and magnetic carrier; and an agitator rotatably mounted in the casing for supplying toner to the developing sleeve. A magnetic roller may be enclosed in an inner-diameter portion of the developing sleeve, and the agitator may include an agitating member having a cleaning brush. Further, an L-shaped light transmitting member may be mounted inside the casing of the developing unit on one side thereof in such a manner that a light emitting surface and a light receiving surface of a photosensor for detecting a toner level are opposed to each other. The light emitting surface and the light receiving surface may be cleaned by the cleaning brush of the agitating member of the agitator.

In the related art mentioned above, however, a light emitting element and a light receiving element of the photosensor may be separately mounted so that the light emitting surface and the light receiving surface are opposed to each other. If the elements are mounted in this manner, the elements may be misaligned, and a high detection accuracy cannot be obtained.

To cope with this problem, it is known to use a photointerrupter for detecting a toner level, as shown in FIG. 9. The photointerrupter, denoted by reference numeral 100 in FIG. 9, has a light emitting element 100A and a light receiving element 100B located close to the outer wall surface of the toner supply chamber. A pair of toner detecting portions 101A and 101B project inward from a wall of the toner supply chamber so as to be interposed between the light emitting element 100A and the light receiving element 100B. The toner detecting portions 101A and 101B are connected by a connecting portion 101C, which may be integrally formed therewith, and which may be formed of a light transmitting material.

With this arrangement, light emitted from the light emitting element 100A passes through the toner detecting portion 101A, through the space between the toner detecting portions 101A and 101B, and then through the toner detecting portion 101B to finally reach the light receiving element 100B. When the toner level in the toner supply chamber is high, the light is blocked by toner between the toner detecting portions 101A and 101B. When the toner level in the toner supply chamber is low, or zero, the light is received by the light receiving element 100B.

However, as shown by an optical path 102A in FIG. 9, there is a possibility that the light from the light emitting element 100A may be repeatedly internally reflected in the toner detecting portions 101A, 101B and the connecting portion 101C such that the light is indirectly transmitted from the light emitting element 100A to the light receiving element 100B. In addition, as shown by an optical path 102B in FIG. 9, there is a possibility that the light from the light emitting element 101A may be simply reflected once on the inner bottom surface of the connecting portion 101C to reach the light receiving element 100B. Light transmitted along the optical paths 102A or 102B can cause a false detection signal indicating "low toner level" or "zero toner level" when the toner level is actually still high.

SUMMARY OF THE INVENTION

It is accordingly an object of the present invention to provide a toner level detecting device which can eliminate such false detection.

In a first embodiment of the present invention, a toner level detecting device includes a pair of toner detecting portions that project into a toner supply chamber. The toner detecting portions are connected by a connecting portion, and are formed of a light transmitting material. The device also includes a toner sensor comprising a light emitting portion and a light receiving portion arranged on opposite sides of the toner detecting portions. At least one of a straight portion and a bent portion of the connecting portion is formed with an irregular reflecting portion or a surface having a light absorptive coating.

The irregular reflecting portion or the surface having a light absorptive coating prevents light emitted from the light emitting portion from being transmitted through the connecting portion to the light receiving portion. Accordingly, it is possible to prevent generation of a false signal indicating "low toner level" or "zero toner level" while the toner level is still high.

In another embodiment of the present invention, the connecting portion for connecting the toner detecting portions is formed of a light transmitting material having a high light attenuation factor. When the light from the light emitting portion is transmitted into the connecting portion, the light is attenuated, thereby preventing the light from passing through the connecting portion and reaching the light receiving portion. Accordingly, false detection of low toner status, as mentioned above, can be prevented.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

Figure 1:
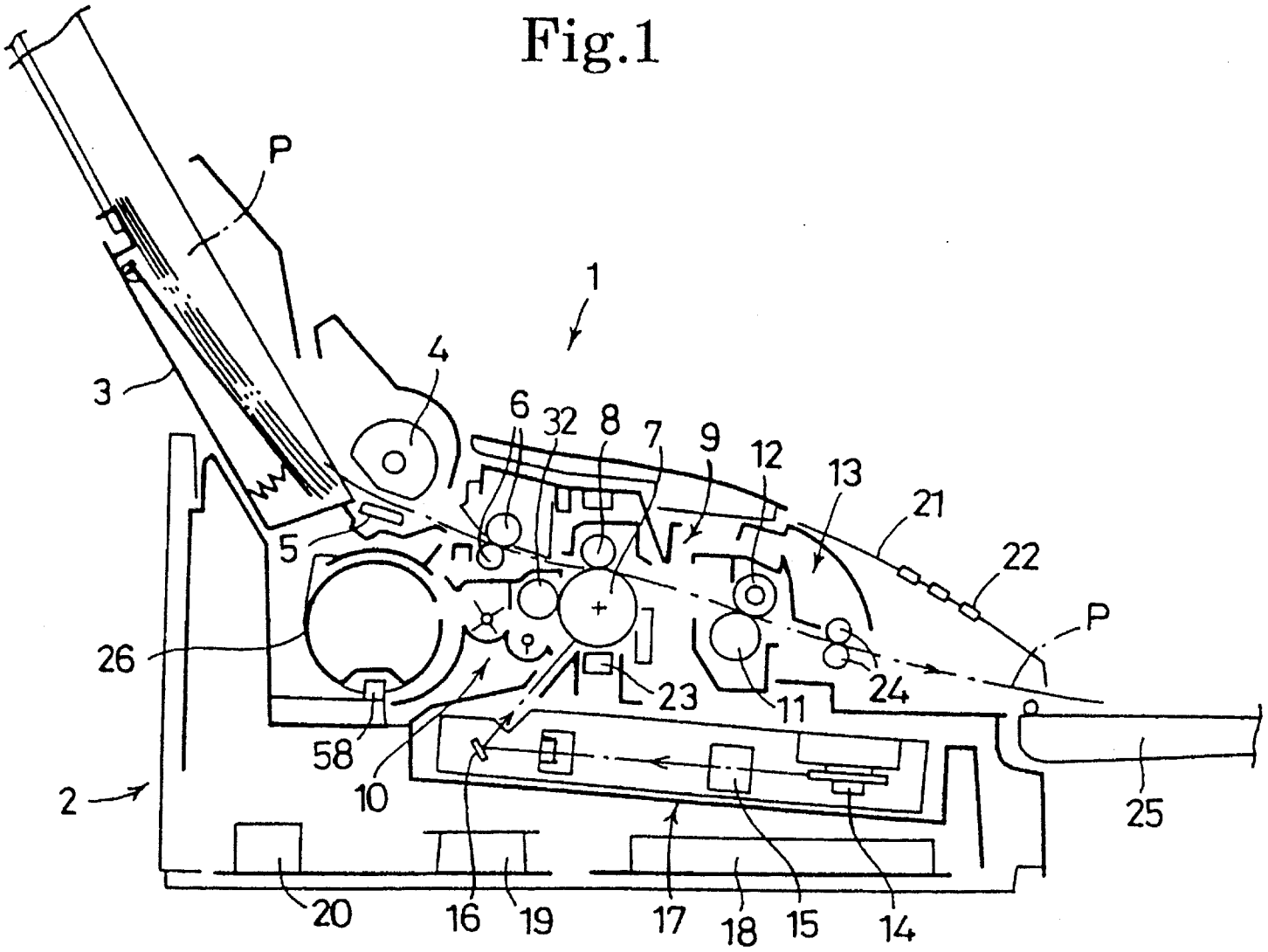
FIG. 1 is a schematic sectional side view of a laser printer.
Figure 2:
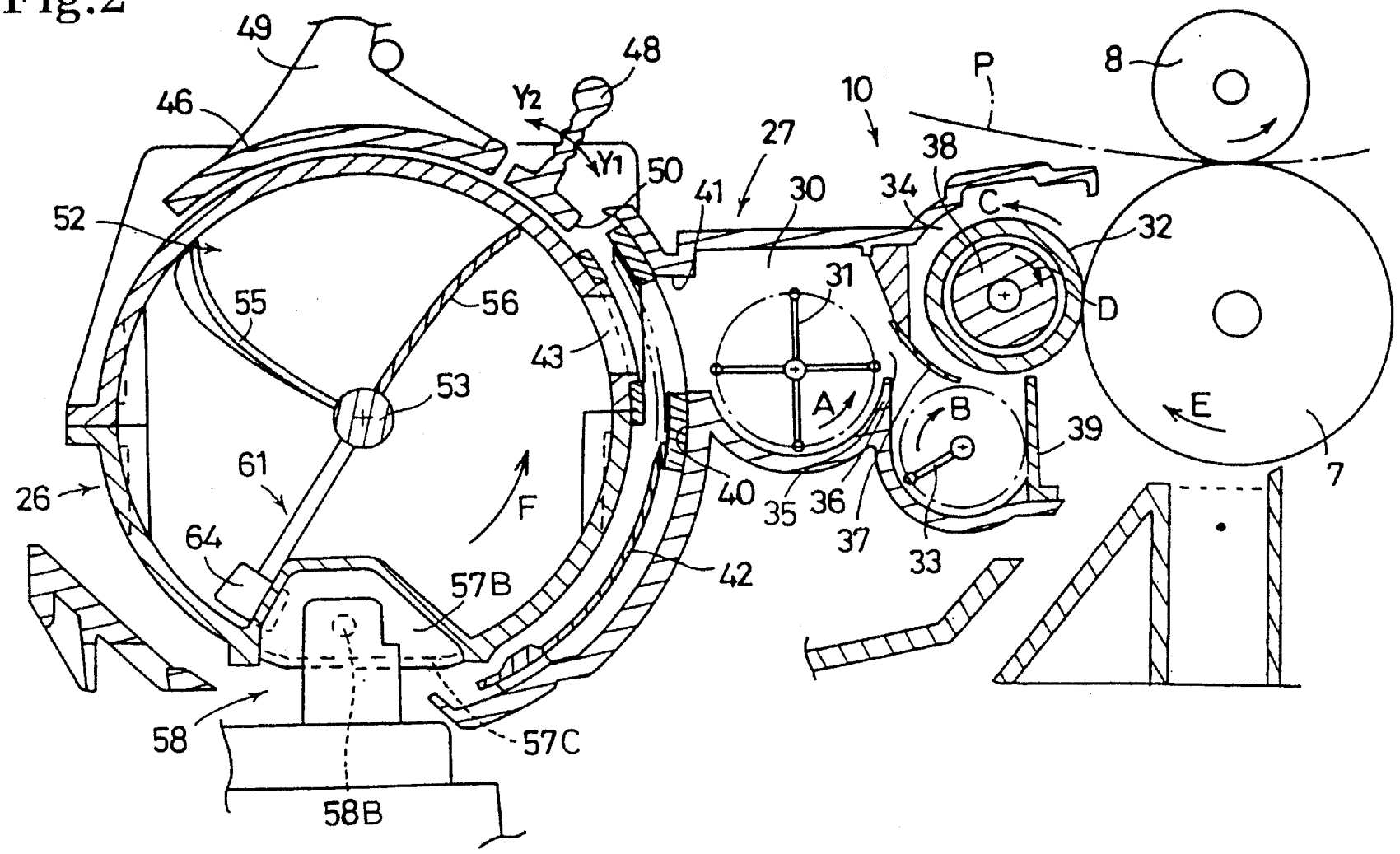
FIG. 2 is a partial sectional side view of an essential part of a developing unit.

Preferred embodiments of the present invention will now be described with reference to the drawings. FIG. 1 is a schematic sectional side view of a printer 1. FIG. 2 is a partial sectional side view of a developing unit 10 that may be used in the printer 1.

In the printer 1 shown in FIG. 1, a paper feed cassette 3 is detachably mounted on the rear upper side of a casing 2. Sheets of paper P stacked in the paper feed cassette 3, which serve as a recording medium, are separated one by one by means of a paper feed roller 4 and a separating pad 5. The sheets P are then fed through a feed roller pair 6 to a photosensitive unit 9 including a photosensitive drum 7 and a transfer roller 8. A developing unit 10 is located adjacent the photosensitive unit 9 on the rear side thereof near the paper feed cassette 3. A fixing unit 13, comprising a heating roller 11 and a pressing roller 12 is located on the front side of the photosensitive unit 9, opposite the developing unit 10.

A scanner unit 17, control boards 18 and 19, and a power unit 20 are located below the photosensitive unit 9. The scanner unit 17 includes a laser generating portion 14, a lens 15, and a reflecting mirror 16. A cover member 21 is provided with a keyboard 22 having a plurality of operating buttons.

The photosensitive drum 7 is preliminarily charged by a charger 23. Light emitted from the scanner unit 17 is then directed onto the surface of the photosensitive drum 7 according to image data transferred from external equipment, such as a computer (not shown), to form an electrostatic latent image on the surface of the photosensitive drum 7. The latent image is developed into a toner image by supplying toner particles to the photosensitive drum 7 from a developing sleeve 32 in the developing unit 10. Thereafter, the toner image formed on the photosensitive drum 7 is transferred to a sheet of paper P fed between the photosensitive drum 7 and a transfer roller 8. Heat and pressure are applied to the toner image on the sheet of paper P in the fixing unit 13 to fix the toner image to the sheet of paper P. Finally, the paper P is ejected through an eject roller pair 24 to a paper eject tray 25.

The developing unit 10 of a preferred embodiment of the present invention will now be described with reference to FIGS. 2 to 8.

As shown in FIG. 2, a casing 27, formed of a synthetic resin or the like, includes a partition wall 35 between an agitation chamber 30 and a development chamber 34. The partition wall 35 has an opening 36 adjacent to the outer circumference of the developing sleeve 32.

A toner box 26 comprises a toner supply chamber for supplying a nonmagnetic toner or a magnetic toner, as a component of a developer, to the agitation chamber 30. The toner box 26 is detachably mounted on a pair of right and left brackets (not shown in FIG. 2) projecting upward from a lower portion of the casing 27. The toner supplied to the agitation chamber 30 is agitated in the agitation chamber 30 by a second agitating member 31 that may include rotary vanes.

A magnetic roller 38 is enclosed in an inner-diameter portion of the developing sleeve 32. A first agitating member 33, which may include rotary vanes or the like, is located below the developing sleeve 32. The developing sleeve 32 and the first agitating member 33 are housed in the development chamber 34. The front side of the outer circumference of the developing sleeve 32 faces the outer circumference of the photosensitive drum 7.

A restriction member 37, which may be formed from an elastic film such as a PET (polyethylene terephthalate) film, and having a magnetic transmitting property, is mounted adjacent the opening 36. The restriction member 37 extends downward into the development chamber 34 adjacent the outer circumference of the developing sleeve 32. A lower or free end of the restriction member 37 is located just outside a locus of rotation of the first agitating member 33.

As shown in FIG. 2, the second agitating member 31 is rotated in a direction of arrow A to scrape up toner from the bottom of the agitation chamber 30 toward the opening 36. The first agitating member 33 is rotated in a direction of arrow B to agitate the toner supplied from the opening 36 along with a magnetic carrier, which is already contained in the development chamber 34. The first agitating member 33 lifts the mixture of the toner and the carrier from the bottom of the development chamber 34 toward the lower surface of the developing sleeve 32. The developing sleeve 32 is rotated in a direction of arrow C. The magnetic roller 38 (which is formed by alternately arranging radially extending N poles and S poles) is rotated in a direction of arrow D. The photosensitive drum 7 is rotated in a direction of arrow E.

A trimmer blade 39 for adjusting the thickness of the layer of toner and magnetic carrier (i.e., the layer thickness of the developer) on the outer circumference of the developing sleeve 32 is located in the development chamber 34 at a position near the outer circumference of the photosensitive drum 7.

The developer (mixture of toner and magnetic carrier) used in this preferred embodiment may be selected from a so-called two-component developer comprised of 95 to 98 wt % of magnetic carrier and 2 to 5 wt % of nonmagnetic toner and a so-called 1.5-component developer comprised of 30 to 80 wt % of magnetic carrier and 20 to 70 wt % of magnetic toner.

As shown in FIG. 2, an arcuate partition wall 40 is provided on the rear side of the agitation chamber 30 (on the side opposite to the partition wall 35). The partition wall 40 is formed with a toner supply opening 41 having a substantially rectangular shape elongated in a direction perpendicular to the plane of FIG. 2. A second shutter 42, which acts as a second shielding member for closing the toner supply opening 41, is mounted on the partition wall 40 so that right and left end portions of the second shutter 42 are arcuately movable along guide grooves (not shown). The second shutter 42 is formed from a thin metal (e.g. aluminum) plate having a sectionally arcuate shape.

The arrangement of the toner box 26 as a toner supply chamber and the developing unit 10 will now be described with reference to FIGS. 3 to 8.

Figure 3:
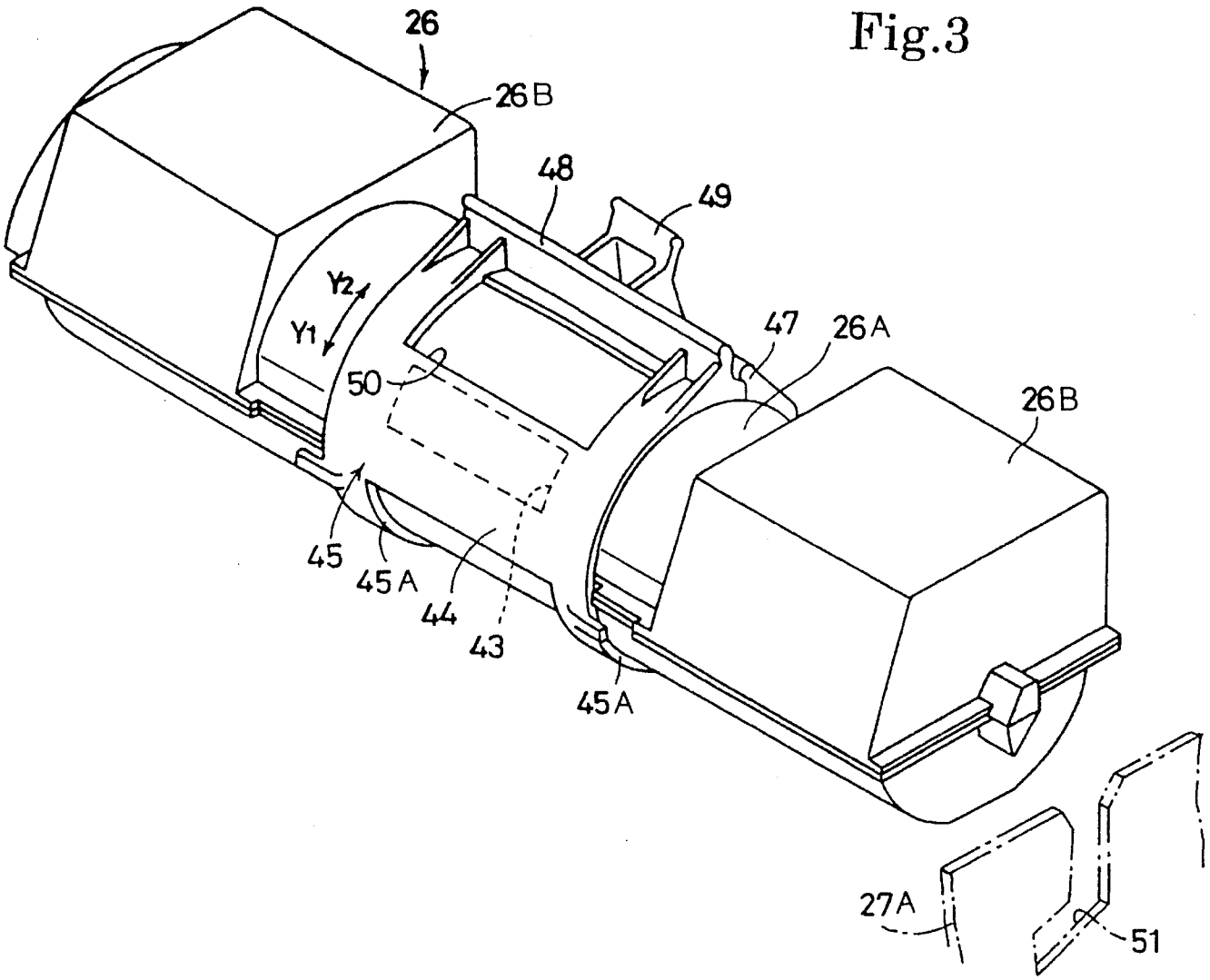
FIG. 3 is a perspective view of a toner box as viewed from the front side thereof.
Figure 4:
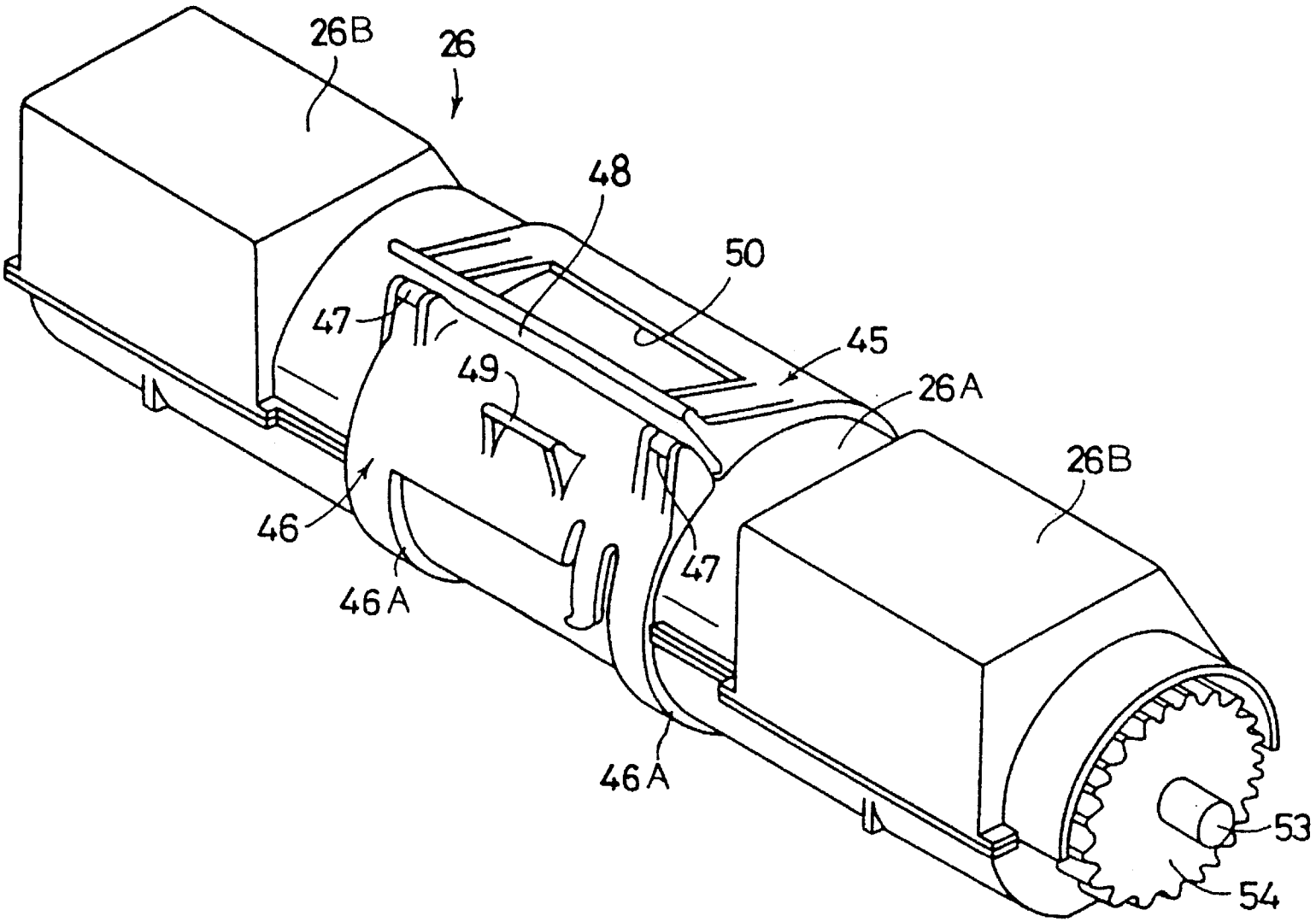
FIG. 4 is a perspective view of the toner box as viewed from the rear side thereof.

As shown in FIGS. 3 and 4, the toner box 26 comprises a cylindrical central portion 26A and right and left end portions 26B (longitudinally opposite end portions). Each of the end portions 26B is configured so that its upper half is rectangular in side elevation and its lower half is arcuate in side elevation. The toner box 26 is detachably mounted to a pair of brackets 27A (only one of which is shown in FIG. 3) projecting from the casing 27 of the developing unit 10.

The central portion 26A of the toner box 26 includes a toner discharge opening 43. When the toner box 26 is mounted in the casing 27, the cylindrical central portion 26A of the toner box 26 is concentric with the arcuate partition wall 40 of the casing 27, and the toner discharge opening 43 is aligned with the toner supply opening 41 of the agitation chamber 30. A first shutter 44, which acts as a first shielding member for closing the toner discharge opening 43, is formed as a part of a first embracing member 45 that is arcuately movable along the outer circumference of the central portion 26A.

Similarly, a second embracing member 46 is also arcuately movable along the outer circumference of the central portion 26A. The first embracing member 45 and the second embracing member 46 are configured to have an arcuate shape in side elevation so as to surround the outer circumference of the central portion 26A in cooperation with each other. The first and second embracing members 45 and 46 are connected together through hinge portions 47 formed at their upper portions. The first embracing member 45 has lower leg portions 45A, and the second embracing member 46 also has lower leg portions 46A. The leg portions 45A on the first embracing member 45 are formed with pawls (not shown) which engage holes (not shown) formed in the leg portions 46A of the second embracing member 45 so that the first and second embracing members 45 and 46 are detachably engaged with each other. Further, handling knobs 48 and 49 project from the outer circumferences of the first and second embracing members 45 and 46, respectively.

The first shutter 44 is formed as a wide surface of the first embracing member 45 at its circumferentially central portion. When the first embracing member 45 is arcuately moved relative to the central portion 26A in a direction of arrow Y1 (in FIG. 3), an opening 50 formed at the upper portion of the first embracing member 45 becomes aligned with the toner discharge opening 43. Conversely, when the first embracing member 45 is arcuately moved relative to the central portion 26A in a direction of arrow Y2 (in FIG. 3), the first shutter 44 operates to close the toner discharge opening 43. Further, when the first embracing member 45 is moved in the direction Y1, engaging portions (not shown) of the first embracing member 45 engage pawls (not shown) formed at right and left ends of the second shutter 42 to move the second shutter 42 downward, thus opening the toner supply opening 41.

Although not described in detail, the first shutter 44 on the toner box 26, and the second shutter 42 on the agitation chamber 30, are locked closed when the toner box 26 is removed from the developing unit 10 to prevent the shutters 44 and 42 from inadvertently opening the toner discharge opening 43 and the toner supply opening 41. Further, when the toner box 26 is installed in the support grooves 51 of the pair of brackets 27A, the shutters 42 and 44 are unlocked. Sealing members formed from a felt material, or the like, are attached to the outer circumferences of the toner supply opening 41 and the toner discharge opening 43 to prevent toner from inadvertently leaking out of the toner box 26.

As shown in FIG. 2, an agitator member 52 is provided in the toner box 26. As shown in FIG. 4, a rotatably mounted shaft 53 attached to the agitator 52 projects from one end of the toner box 26, and a gear 54 is mounted on an end of the shaft 53. When the toner box 26 is mounted on the casing 27, the gear 54 is connected to a driving mechanism (not shown), which rotatably drives the rotating shaft 53 in a direction of arrow F in FIG. 2.

Figure 5:
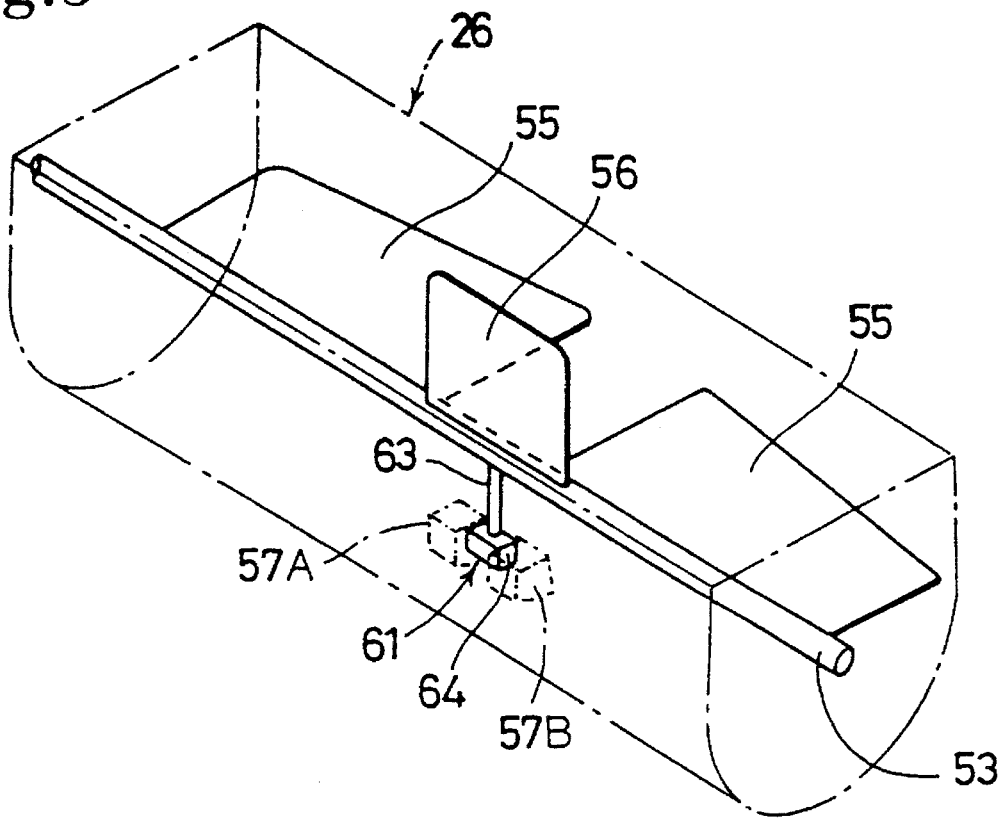
FIG. 5 is a perspective view of an agitator provided in the toner box.
Figure 6:
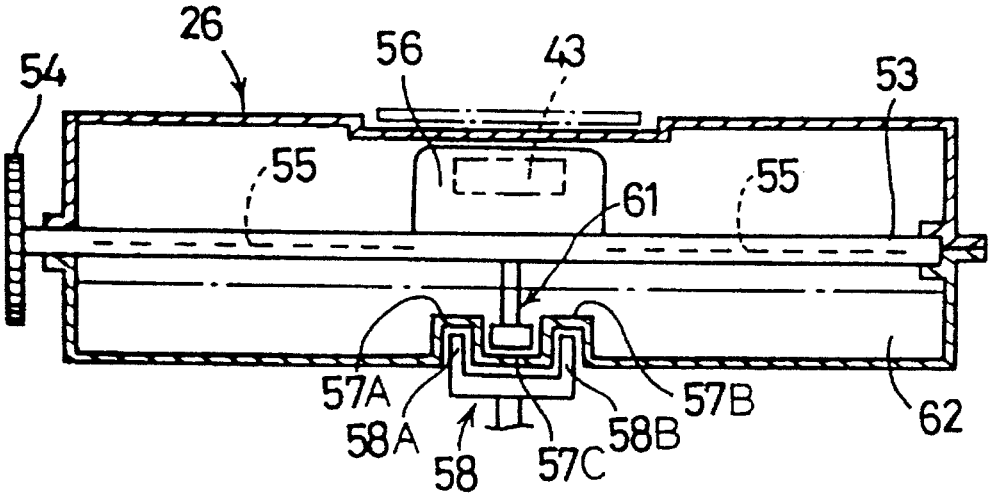
FIG. 6 is a sectional view of the toner box, showing the agitator.

As shown in FIGS. 5 and 6, the agitator 52 includes two first agitating members 55 mounted on the rotating shaft 53 at right and left end ends. A second agitating member 56 is mounted on at a central portion of the rotating shaft 53 so as to be circumferentially offset from the first agitating members 55 by approximately 90°. The first and second agitating members 55 and 56 may be formed of a flexible material such as a polyester resin film. The second agitating member 56 is located so as to be aligned with the toner discharge opening 43.

As shown in FIG. 6, a pair of toner detecting portions 57A and 57B are formed on the bottom surface of the toner box 26 at its longitudinally central portion so as to project radially inward. The toner detecting portions 57A and 57B are connected by a connecting portion 57C. At least the toner detecting portions 57A and 57B and the connecting portion 57C are formed of a light transmitting material. In a preferred embodiment, the lower half of the toner box 26 is integrally molded from a light transmitting material such as polyethylene.

Figure 7:
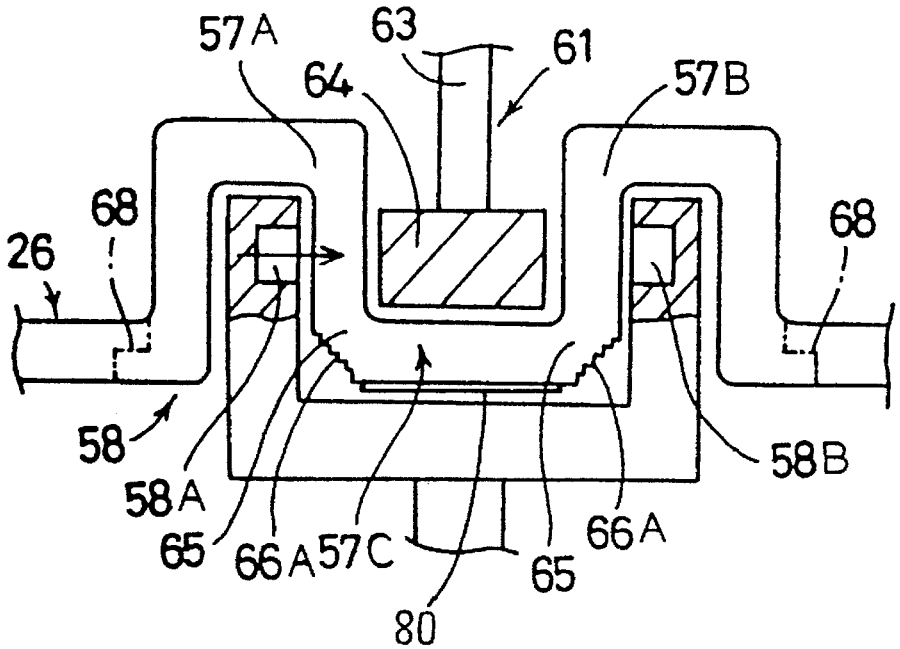
FIG. 7 is an enlarged sectional view of an essential part of a toner level detecting device according to a preferred embodiment of the present invention.

As shown in FIG. 7, two bent portions 65 are formed between the toner detecting portions 57A and 57B and the connecting portion 57C. The outside corners of the bent portions 65 are formed as small-stepped portions 66A. In a preferred embodiment, these small-stepped portions 66A function as irregular reflecting portions. Alternatively, the irregular reflecting portions 66A may be formed as surfaces having a high surface roughness.

A toner sensor 58, such as a photointerrupter, including a light emitting portion 58A and a light receiving portion 58B is mounted adjacent the toner detecting portions 57A and 57B so that the toner detecting portions 57A and 57B are interposed between the light emitting portion 58A and the light receiving portion 58B. As shown in FIGS. 2 and 5, a cleaning member 61 is mounted on the rotating shaft 53 so as to pass between the toner detecting portions 57A and 57B during rotation of the rotating shaft 53. The cleaning member 61 passes between the opposed inner wall surfaces of the toner detecting portions 57A and 57B and wipes out toner 62 from between the toner detecting portions 57A and 57B. The cleaning member 61 functions not only as an agitating member, but also as a member used for toner level detection.

In this preferred embodiment, the cleaning member 61 includes an arm 63 mounted at one end to the rotating shaft 53, and a block 64 mounted on the other end of the arm 63. The block 64 may be formed of a transparent synthetic resin. The block 64 is adapted to lie on an optical path extending from the light emitting portion 58A to the light receiving portion 58B of the toner sensor 58. That is, when the cleaning member 61 is rotated with the rotating shaft 53 in the direction F, as shown in FIG. 2, the transparent block 64 passes between the toner detecting portions 57A and 57B, and light emitted from the light emitting portion 58A passes through the transparent block 64 and can be directly received by the light receiving portion 58B.

After the block 64 passes between the toner detecting portions 57A and 57B, the space between the toner detecting portions 57A and 57B is filled with toner 62, which interrupts the transmission of light. Accordingly, light from the light emitting portion 58A cannot be received by the light receiving portion 58B when toner is present in the bottom of the toner box 26.

More specifically, when a toner level in the toner box 26 is high, light from the light emitting portion 58A is allowed to be received by the light receiving portion 58B for only a short period of time when the transparent block 64 passes between the toner detecting portions 57A and 57B. At this time, the toner sensor 58 becomes ON. During a long period of time other than this ON time, toner in the toner box 26 blocks the light, and the light is not allowed to be received by the light receiving portion 58B. Accordingly, the toner sensor 58 remains OFF.

The lower the toner level in the toner box 26, the longer the period of time until toner 62 fills the space between the toner detecting portions 57A and 57B after passage of the transparent block 64 therebetween. Accordingly, as the toner level becomes lower, the OFF time of the toner sensor 58 becomes shorter. When the toner level becomes very low, the light from the light emitting portion 58A is always received by the light receiving portion 58B, even during the period of time before and after passage of the transparent block 64 between the toner detecting portions 57A and 57B. Accordingly, the ON time becomes long. Information from the sensor 58 is received by a control device (not shown) mounted in the printer, which interprets the sensor information to determine the toner level in the toner box 26.

As mentioned above, the bent portions 65 at the opposite ends of the connecting portion 57C may be formed with irregular reflecting portions 66A as rough surfaces or small-stepped surfaces (surfaces with small repeated notches), as shown in FIG. 7. With this structure, light emitted from the light emitting portion 58A first enters the toner detecting portion 57A and is repeatedly internally reflected in the toner detecting portion 57A as it advances toward the connecting portion 57C. Light that reaches the connecting portion 57C is irregularly reflected (or irregularly refracted) on the irregular reflecting portions 66A. Therefore, the possibility that light will travel through the connecting portion 57C in a direction substantially parallel to its longitudinal direction is reduced or eliminated. That is, light from the toner detecting portion 57A is prevented from being transmitted through the connecting portion 57C to the other toner detecting portion 57B. Accordingly, it is possible to prevent a false "low toner level" or "zero toner level" signal when the toner level is actually still high.

Figure 8:
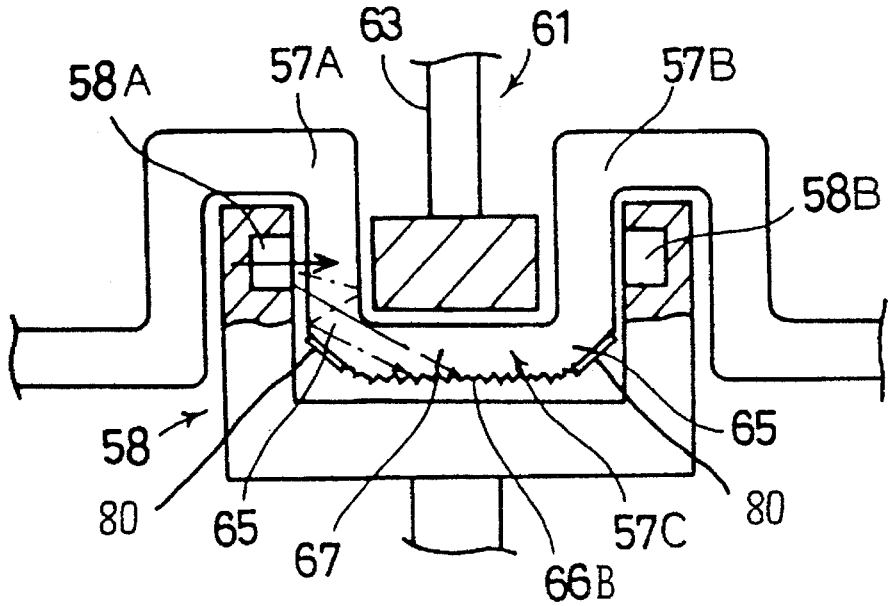
FIG. 8 is a view similar to FIG. 7, showing another preferred embodiment of the present invention.
Figure 9:
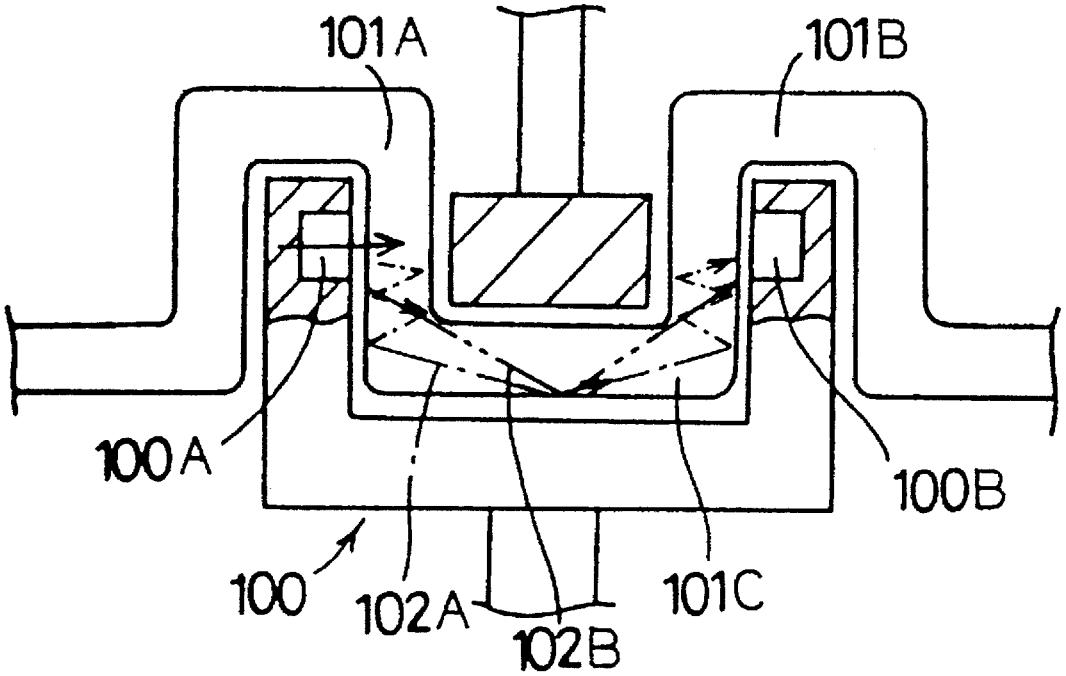
Fig.9 PRIOR ART
FIG. 9 is an enlarged partial sectional view of an essential part of a toner detecting device of the prior art.

FIG. 8 shows another preferred embodiment of the present invention. In FIG. 8, reference numeral 67 denotes a straight portion of the connecting portion 57C between the bent portions 65. The straight portion 67 has upper and lower surfaces, and at least one of the two surfaces of the straight portion 67 has an irregular reflecting portion 66B. The irregular reflecting portion 66B has a rough surface or a small-stepped surface (a surface with small repeated notches) over a certain length between the two bent portions 65. Preferably, the irregular reflecting portion 66B is formed on the lower surface of the straight portion 67, which is the surface that light from the light emitting portion 58A is directly reflected upon, as shown in FIG. 8. According to this preferred embodiment, when light from the light emitting portion 58A is reflected onto the lower surface of the straight portion 67, the light is irregularly reflected by the irregular reflecting portion 66B formed on the lower surface of the straight portion 67. The irregular reflecting portion 66B reduces the energy of light reaching the light receiving portion 58B. Therefore, a false low toner level signal, as mentioned above, can be prevented.

In another embodiment, a coating layer 80, formed of a material having a high absorptivity of light, such as a black or brown coating material, may be applied to the outer surface of the bent portions 65 and/or the straight portion 67 (as shown in FIG. 7 and FIG. 8) to thereby form a light absorptive surface. In this embodiment, a similar effect can be obtained.

In another embodiment, both the toner detecting portions 57A and 57B and the connecting portion 57C, or only the connecting portion 57C (inclusive of the bent portions 65 and the straight portion 67), may be formed of a translucent material that attenuates light emitted from the light emitting portion 58A of the toner sensor 58. This embodiment can obtain similar results to the embodiments described above. When the toner box 26 is completely formed of a translucent material colored brown or gray, both the toner detecting portions 57A and 57B and the connecting portion 57C, or just the bent portions 65, or just the straight portion 67 may be formed with irregular reflecting portions (such as the irregular reflecting portions 66A and 66B shown in FIG. 7 and 8, respectively). Alternatively, both the irregular reflecting portions 66A and the irregular reflecting portion 66B may be omitted in this embodiment.

In another embodiment, the toner detecting portions 57A and 57B and the connecting portion 57C may be formed of a translucent material colored differently from the remaining material of the toner box 26. In this embodiment, the toner detecting portions 57A and 57B, and the connection portion 57C may be formed as a unit which is bonded to the toner box 26, as shown by dot-dash lines 68 in FIG. 7.

In another embodiment, the arm 63 and the block 64 that comprise the cleaning member 61 may be formed of an opaque material. In addition, a cleaning brush (not shown) for cleaning the opposed inner wall surfaces of the toner detecting portions 57A and 57B may be implanted on the side surfaces of the opaque block 64 that face the toner detecting portions 57A and 57B. Alternatively, the block 64 may be replaced with a flexible film (not shown) directly attached to the arm 63 for cleaning the opposed inner wall surfaces of the toner detecting portions 57A and 57B.

In the above described embodiment, where the cleaning member 61 is formed of an opaque material, for a short period of time immediately after the cleaning member 61 passes through the space between the toner detecting portions 57A and 57B, light from the light emitting portion 58A may pass through the cleared space and reach the light receiving portion 58B. Subsequently, toner 62 falls into the space between the toner detecting portions 57A and 57B to fill the space and interrupt the light. When the toner level in the toner box 26 is high, the period of time T that light is allowed to be received by the light receiving portion 58B before the light is interrupted is relatively short. This period of time T increases with a decrease in the toner level. When the toner level becomes very low, the light continues to be received by the light receiving portion 58B for long periods of time. In this embodiment, the bent portions 65 or the straight portion 67 of the connecting portion 57C may be formed with the irregular reflecting portions 66A and 66B as shown in FIG. 7 and 8, respectively. Alternatively, the bent portions 65 and/or the straight portion 67 may be coated with a light absorptive material. In addition, the toner detecting portions 57A and 57B and the connecting portion 57C may be formed of a translucent material. In each of these embodiments, a similar effect can be obtained.

While this invention has been described in conjunction with specific embodiments thereof, it is evident that many alternatives, modifications and variations will be evident to those skilled in the art. Accordingly, the preferred embodiments of the invention as set forth herein are intended to be illustrative, not limiting. Various changes may be made without departing from the spirit and scope of the invention, as defined in the following claims.

What is claimed is:

1. A toner level detecting device on a toner storage box, comprising:

first and second toner detecting portions formed of a light transmissive material; and a connecting portion connecting the first and second toner detecting portions, the connecting portion having means for attenuating light passing through the connecting portion, wherein the first and second toner detecting portions and the connecting portion are formed such that toner in the toner storage box can fill an aperture between the first and second toner detecting portions.

2. The toner level detecting device of claim 1, wherein the means for attenuating light passing through the connecting portion comprises an irregular reflecting portion formed on a surface of the connecting portion.

3. The toner level detecting device of claim 2, wherein the irregular reflecting portion comprises a small-stepped portion formed on a surface of the connecting portion.

4. The toner level detecting device of claim 2, wherein the irregular reflecting portion comprises a surface portion having a high surface roughness.

5. The toner level detecting device of claim 1, wherein the means for attenuating light passing through the connecting portion comprises a light absorbative coating layer on a surface of the connecting portion.

6. The toner level detecting device of claim 5, wherein the light absorbative coating layer is provided on at least one bent portion of the connecting portion.

7. The toner level detecting device of claim 5, wherein the connecting portion comprises a straight portion, the straight portion comprising first and second flat surfaces that are substantially parallel to one another, and wherein the light absorbative coating layer is provided on at least one of the first and second flat surfaces.

8. The toner level detecting device of claim 1, wherein the means for attenuating light passing through the connecting portion comprises forming at least the connecting portion of a light attenuating material.

9. The toner level detecting device of claim 8, wherein the means for attenuating light passing through the connecting portion further comprises an irregular reflecting portion formed on a surface of the connecting portion.

10. The toner level detecting device of claim 9, wherein the irregular reflecting portion is formed on a straight portion of the connecting portion.

11. The toner level detecting device of claim 9, wherein the irregular reflecting portion is formed on a bent portion of the connecting portion.

12. The toner level detecting device of claim 8, wherein the means for attenuating light passing through the connecting portion further comprises a light absorbative coating layer formed on at least one surface of the connecting portion.

13. The toner level detecting device of claim 12, wherein the light absorbative coating layer is formed on at least one substantially straight surface portion of the connecting portion.

14. The toner level detecting device of claim 12, wherein the light absorbative coating layer is formed on at least one bent surface portion of the connecting portion.

15. A toner storage box, comprising:

a casing for containing toner;

a toner level detecting device on the casing, comprising:

first and second toner detecting portions formed of a light transmissive material, and a connecting portion connecting the first and second toner detecting portions, the connecting portion having means for attenuating light passing through the connecting portion, wherein the first and second toner detecting portions and the connecting portion are formed such that toner in the toner storage box can fill an aperture between the first and second toner detecting portions;

a rotating shaft provided in said casing, said rotating shaft being rotatable by a mechanism outside the casing; and a cleaning member attached to said rotating shaft, wherein rotation of the rotating shaft causes the cleaning member to pass between opposed inner surfaces of said first and second toner detecting portions to clean toner from between the first and second toner detecting portions and to clean toner off the opposed inner surfaces.

16. The toner storage box of claim 15, wherein the cleaning member is formed of a light transmissive material.

17. The toner storage box of claim 15, wherein the cleaning member is formed of an opaque material.

18. The toner storage box of claim 15, wherein the cleaning member comprises a flexible film for cleaning the opposed inner surfaces of the first and second toner detecting portions.

19. The toner storage box of claim 15, wherein the means for attenuating light passing through the connecting portion comprises an irregular reflecting portion formed on at least one surface of the connecting portion.

20. The toner storage box of claim 15, wherein the means for attenuating light passing through the connecting portion comprises a light absorbative coating layer on at least one surface of the connecting portion.

21. The toner storage box of claim 15, wherein the means for attenuating light passing through the connecting portion comprises forming at least the connecting portion from a light attenuating material.

* * * * *